United States Patent [19]

Kilgour

[11] Patent Number: 4,538,858

[45] Date of Patent: Sep. 3, 1985

[54] APPARATUS FOR DRILLING AND INSERTING A HORIZONTAL PIPE

[76] Inventor: Jonathan R. Kilgour, 40570 Harris Rd., Belleville, Mich. 48111

[21] Appl. No.: 639,743

[22] Filed: Aug. 13, 1984

[51] Int. Cl.[3] ..... E21B 3/00

[52] U.S. Cl. ..... 299/55; 166/62; 166/122

[58] Field of Search ..... 299/55; 175/62, 203, 175/122, 162; 173/144, 44, 152

[56] References Cited

U.S. PATENT DOCUMENTS

| | | | |
|---|---|---|---|
| 3,610,345 | 10/1971 | Richmond | 175/122 |
| 3,682,261 | 8/1972 | Bird | 175/122 |
| 3,886,999 | 6/1975 | Appleman | 175/122 |
| 3,912,024 | 10/1975 | Richmond et al. | 175/122 |

*Primary Examiner*—Stephen J. Novosad

*Assistant Examiner*—Michael Goodwin

*Attorney, Agent, or Firm*—Charles W. Chandler

[57] ABSTRACT

A horizontal earth boring machine is disclosed of the type in which a carriage supports an engine rotatably connected to an auger, and a push ring. The carriage is movable along a set of tracks between a forward position and a rearward position. Hydraulic means power the carriage between its forward and rearward positions. In one version, the auger and push ring are connected by a universal joint to the engine so that a pair of hydraulic cylinders can raise the push ring and planetary gear reduction unit to an adjusted position above the track in order to accommodate any vertical misalignment of the push ring as it is pushing pipe through a horizontal hole drilled by the auger.

In another version, the carriage is pivotal right to left to accommodate misalignment of the push ring.

4 Claims, 4 Drawing Figures

APPARATUS FOR DRILLING AND INSERTING A HORIZONTAL PIPE

BACKGROUND OF THE INVENTION

This invention is related to horizontal earth drilling machines of the type in which an auger and a push ring are carried between forward and rearward positions along a set of tracks as the auger progressively drills a horizontal hole in the ground and the push ring pushes a section of pipe into the hole being drilled, and more particularly to such apparatus in which the height of the push ring above the track can be adjusted to accommodate misalignment between the hole being drilled and the desired center line of the hole.

Horizontal earth drilling machines are employed for drilling and inserting a horizontal pipe such as beneath a roadway or the like. The pipe is inserted in standard sections such as 10 or 20 foot lengths. The drilling apparatus is usually inserted in a pit at the inlet of the pipe line and moved between forward and rearward positions. When the carriage is moved to its rearward position, a section of auger is connected between the drill head and the machine, and a section of pipe is mounted with its rearward end engaged by the push ring and its forward end adjacent the hole being drilled. The carriage then advances toward its forward position while the auger drills a hole and the pipe is pushed into the hole being drilled. Upon completion of the drilling stroke, the carriage is returned toward its rearward position so that a new length of auger and a new section of pipe can be mounted between the apparatus and the hole.

One of the problems with drilling such a pipe line, is that usually the outlet of the hole being drilled must precisely intersect another section of pipe installed at the outlet. The centerline of the hole is determined by surveying instruments and periodically checked as the drilled hole progresses.

Under some circumstances such as where the auger encounters rocks or the pipe drifts under pressure, the drilled hole becomes misaligned. The conventional practice is to use a crane to raise the track and place shims under the track in order to realign the carriage so that the pipe is moved along the correct path of motion. This procedure is time-consuming as well as very difficult because of the weight of the equipment and the necessary precision. In addition, it is very costly because of the personnel who are not productively employed while the machine is being shimmed.

SUMMARY OF THE INVENTION

The broad purpose of the present invention is to provide a horizontal earth boring machine having hydraulic means for raising or lowering the push ring with respect to the track.

In one embodiment of the invention, the push ring is connected to the engine by a universal joint so that the push ring and auger can be pivoted with respect to both the engine and the track. In another embodiment of the invention, the entire carriage is pivoted with respect to the track, that is, both the engine and the push ring.

The invention obviates the necessity of shimming the base on which the track is mounted. It can be accomplished in a relatively short period of time with greater accuracy than the conventional practice, without employing cranes and chains for lifting the drilling machine base.

Another object of the invention is to provide a horizontal drilling apparatus in which the push ring has a pair of feet with hydraulic means for raising and lowering the push ring so that it can lift a section of pipe in a manner of a forklift truck.

Still another object of the invention is to provide means for horizontally adjusting the position of the push ring in a direction transverse to the track.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
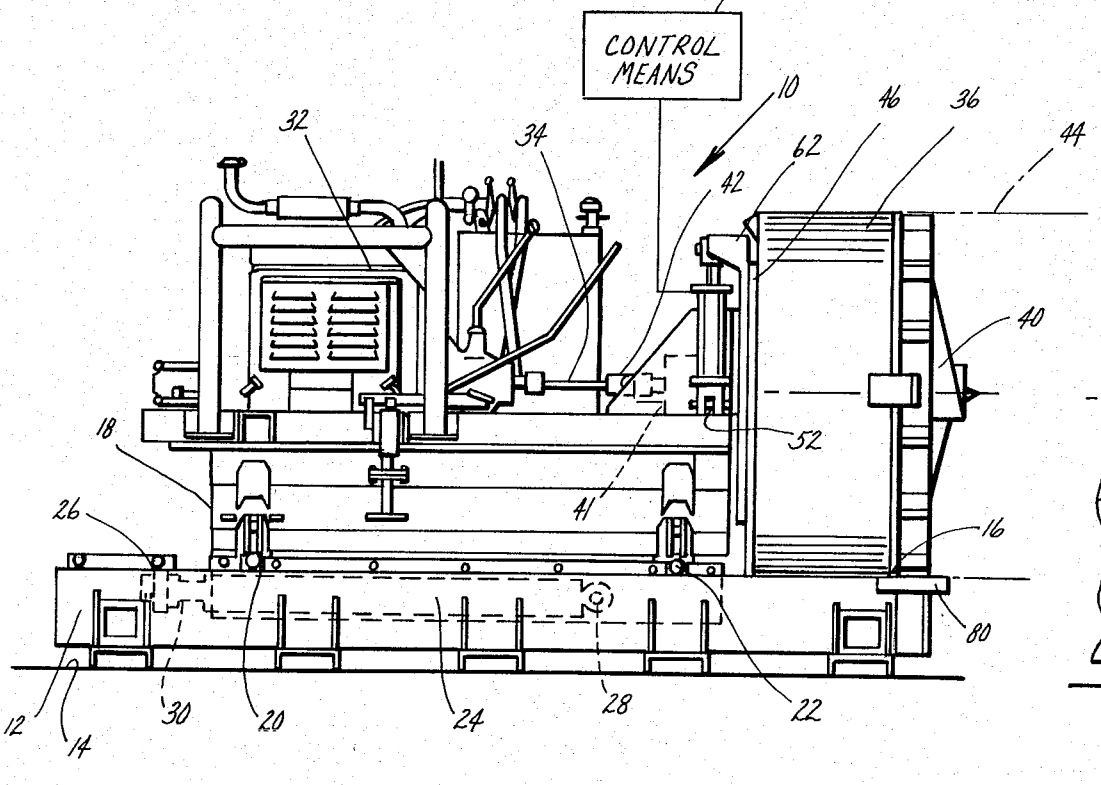
FIG. 1 is an elevational view of a horizontal earth drilling machine illustrating the preferred embodiment of the invention with the push ring in its lower position.

Referring to the drawings, FIG. 1 illustrates a preferred drilling apparatus 10 comprising an elongated base 12 supported on ground 14. In practice the base is usually disposed in a pit adjacent the inlet of an opening that is to be drilled through an embankment (not shown). The top of the base provides track means 16 extending along the base.

A carriage 18 having roller means 20 and 22 is movably mounted on track means 16. An elongated hydraulic actuator 24 is mounted in the base means and has one end connected at 26 to the base and its opposite end connected at 28 to the carriage in such a manner that as piston rod 30 of the actuator is extended, the carriage is moved toward the right and as the piston rod is retracted, the carriage is moved toward the left as viewed in FIG. 1. This basic structure is conventional and is available in a commercial drilling device made by the Richmond Manufacturing Company of Ashland, Ohio. Other sections of track are mounted at the forward or right end of the base as viewed in FIG. 1.

Engine means 32 are mounted on the carriage and have a rotatable shaft 34. A cylindrical, push ring 36 is mounted at the opposite end of the carriage so as to move with the carriage. The push ring is slideably mounted on track means 16. Auger means 40 are mounted within the push ring and connected by planetary gear reduction means 41 and universal joint 42 to shaft 34 so as to be rotated by the engine.

In use, a section of auger is attached to auger means 40 and disposed within a section of pipe 44, illustrated in phantom, in such a manner that as the auger means removes dirt from the hole, it forms an opening for pushing pipe 44 into the drilled opening.

Figure 2:
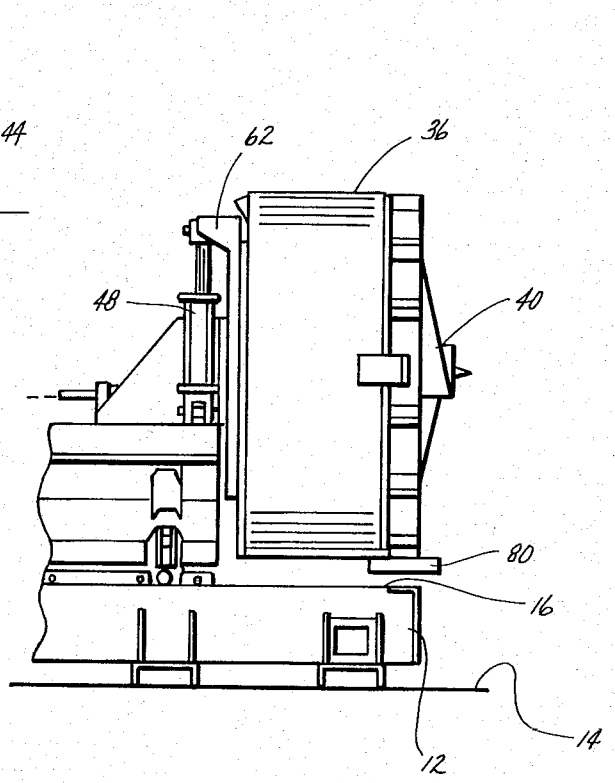
FIG. 2 is a fragmentary view similar to FIG. 1, but showing the push ring in a raised, adjusted position.
Figure 3:
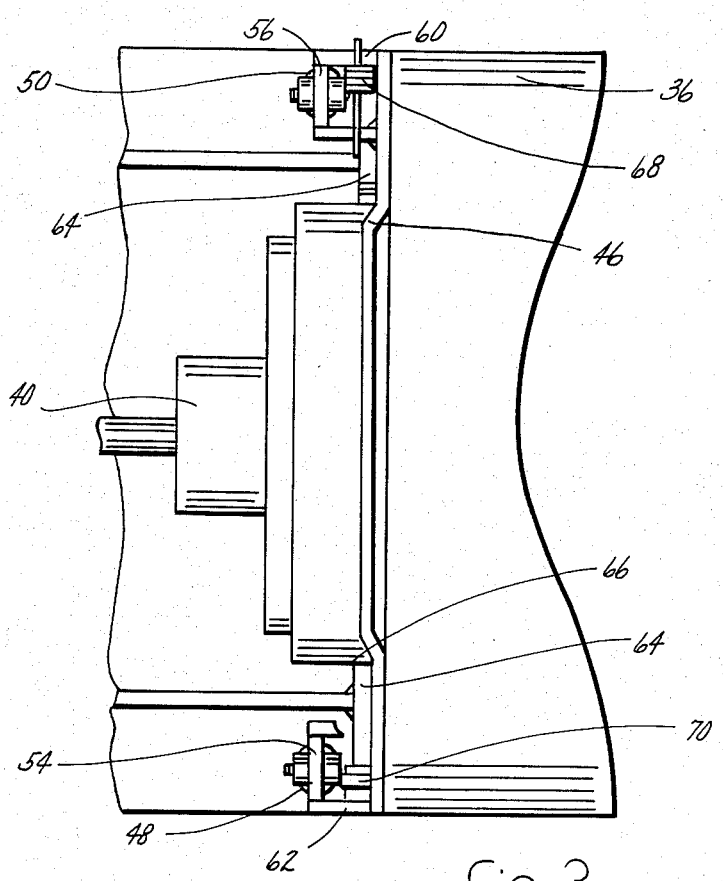
FIG. 3 is a horizontal fragmentary plan view of the push ring to show the manner in which shims are employed to adjust the horizontal position of the push ring right to left.

Plate 46 is mounted on the rear of the push ring and has an opening for the auger. A pair of hydraulic actuators 48 and 50 have their lower ends connected, as at 52, to the carriage and their upper ends connected to supports 54 and 56, as best illustrated in FIG. 3, to raise the push ring to an adjusted position above the track, as illustrated in FIG. 2. FIG. 1 illustrates the push ring in its lower position resting on the track means while FIG. 2 illustrates the hydraulic actuator extended to raise the push ring to a selected height.

As best viewed in FIG. 3, plate 46 terminates at its opposite sides with short plates 60 and 62. The carriage carries a plate 64 which is disposed between short plates 60 and 62. Plate 64 has an opening 66 to accommodate the auger. Shim means 68 are disposed between plate 64 and plate 60 while a second set of shim means 70 are disposed between plate 64 and plate 62. The thickness of shim means 68 and 70 provide means for horizontally adjusting the push ring with respect to the carriage.

Shim means 68 and 70 are elongated and vertically, slideably mounted in position so that they can be raised by the user and replaced by other shim means to precisely adjust the horizontal position of the push ring right to left.

In use, the apparatus is employed in the conventional manner, that is, with the push ring slideably mounted on the track means and supporting the auger means. As the engine rotates the auger means it drills an opening into which pipe 44 is pushed by the actuator 24 as it moves the carriage toward the right as viewed in FIG. 1. After each section of pipe is inserted in the drilled hole the user can employ surveying instruments (not shown) to determine whether the drilled hole is aligned with the desired centerline of the hole. If it is not, the user can precisely raise the push ring and the auger to an adjusted height above the track means without having to shim up the base of the apparatus which is the conventional practice. He can also adjust the horizontal position of the push ring either right or left, by adjusting shim means 68 and 70. The hydraulic actuators are connected to appropriate control means 72 for either raising or lowering the position of the push ring.

A pair of feet 80 are attached to the lower side of the push ring so that the user can engage a section of pipe and maneuver it in the manner of a forklift truck by actuating hydraulic actuators 48 and 50.

Figure 4:
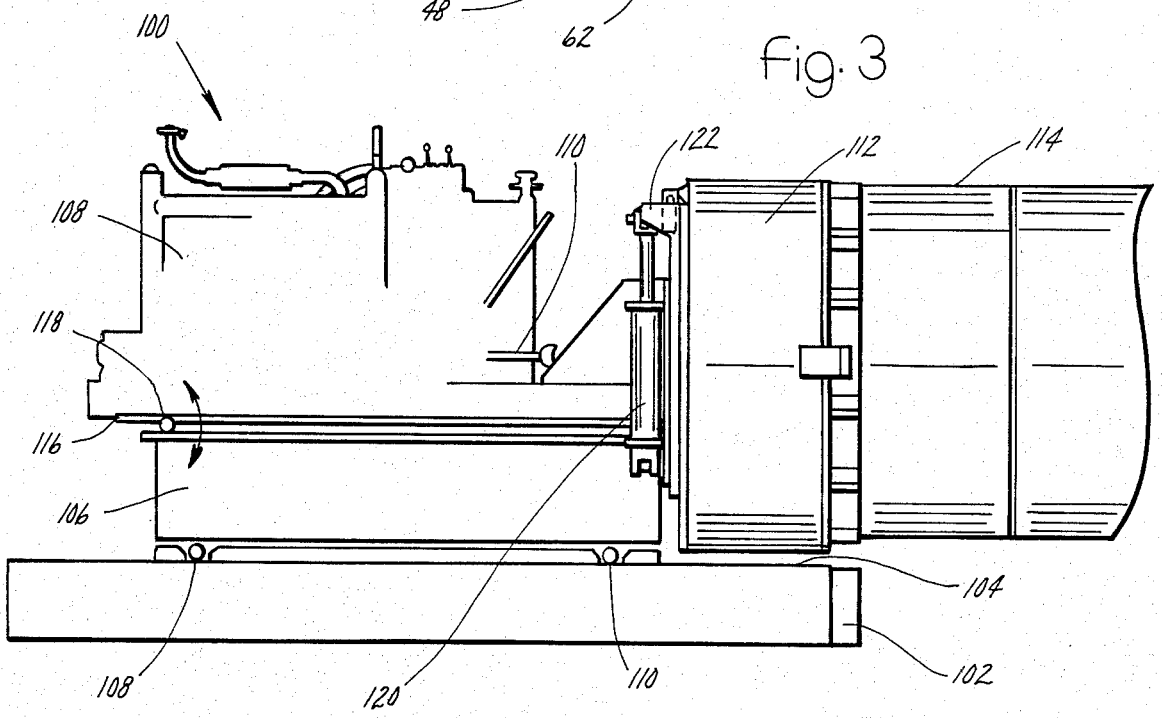
FIG. 4 is a view of another embodiment of the invention in which the entire carriage is pivoted with respect to the track.

Referring to FIG. 4, another preferred drilling apparatus 100 is illustrated and comprises a base 102 having track means 104 on its upper surface. A carriage 106 has roller means 108 and 110 mounted on the track means so that the carriage can be moved along the track means by a hydraulic actuator (not shown) but similar to that illustrated in FIG. 1. In this embodiment, engine means 108 is connected by shaft 110 to an auger (not shown) mounted within push ring 112 to insert a section of pipe 114 in the usual manner. The engine means and push ring are mounted on frame 116 which is pivotally mounted by pivot means 118 on the carriage so that the engine, the push ring and auger means are pivoted together to adjust the vertical position of push ring 112 with respect to the track 104. Hydraulic means 120, having one end connected to the carriage and its upper end connected at 122 to the push ring, provide means for the operator to raise and lower the push ring to an adjusted height.

Thus it is to be understood that I have described an improved means for realigning an auger in a horizontal earth drilling machine by adjusting the height of push ring and auger with respect to the track means as opposed to shimming the entire base of the device. The invention eliminates the necessity for employing cranes and chains for lifting the entire base of the machine in order to insert shims between the base and the ground. It not only saves a considerable amount of time since the user need employ a control handle for either raising or lowering the device in a short period of time, but it provides further savings by reducing the non-productive time of the personnel associated with the machine when the push ring is being adjusted.

Having described my invention, I claim:

1. Apparatus for boring a generally horizontal hole in soil and inserting a pipe into the hole, comprising:

an elongated base, and track means mounted on the base;

a carriage mounted on the track means so as to be movable therealong from a first position toward a second position along a path of motion parallel to the track means;

first power means connected between the base and the carriage for moving the carriage from said first position towards said second position;

rotary drive means mounted on the carriage;

auger means, including a cutting edge, connected to the rotary power means for boring a hole in soil as the carriage is being moved from said first position towards said second position;

pipe pushing means including a push ring of a first diameter, mounted on the carriage so as to be movable therewith in a pipe pushing motion to push a section of pipe into the hole bored by the auger means, the pipe pushing means being movable with respect to the carriage in a direction generally normal to the path of motion of the carriage on the track means; and second power means connected to the pipe pushing means for either raising or lowering the push ring and the auger means an adjusted distance with respect to the track means from a first pipe pushing position to a second pipe pushing position, whereby, the same diameter push ring may be moved in a pipe pushing motion with the carriage at such time as the push ring is disposed in either said first pipe pushing position or said second pipe pushing position.

2. Apparatus as defined in claim 1, in which said auger means is mounted on the carriage so as to extend through the pipe pushing means.

3. Apparatus as defined in claim 1, in which the carriage is pivoted with respect to the track means by the second power means to adjust the distance between the pipe pushing means and the track means.

4. Apparatus as defined in claim 1 in which the second power means comprises a power cylinder means.

* * * * *